US005503524A

United States Patent [19]

Yu

[11] Patent Number: 5,503,524

[45] Date of Patent: Apr. 2, 1996

[54] HOUSING FOR CEILING FAN

[76] Inventor: Jack Yu, No. 109-1, Avenue 6, Lane 164, Tzong Sa Road, Da Dun Hsiang, Taichung Hsien, Taiwan

[21] Appl. No.: 489,480

[22] Filed: Jun. 12, 1995

[51] Int. Cl.[6] ..... F04D 29/00

[52] U.S. Cl. ..... 416/5; 416/93 R; 417/423.14; 310/89

[58] Field of Search ..... 416/5, 93 R, 170 R; D23/377, 379, 385, 411; 417/423.14; 310/89; 362/147, 363, 367

[56] References Cited

U.S. PATENT DOCUMENTS

| | | | |
|---|---|---|---|
| 4,356,540 | 10/1982 | Goralnik | 362/147 |
| 4,382,400 | 5/1983 | Stutzman | 416/5 |
| 4,518,314 | 5/1985 | Schultz | 416/5 |
| 4,626,970 | 12/1986 | Huang | 416/5 |
| 4,863,346 | 9/1989 | Lin | 416/5 |
| 5,439,350 | 8/1995 | Yu | 416/5 |
| 5,441,387 | 8/1995 | Yu | 416/5 |

OTHER PUBLICATIONS

Beverly Hills Fan Company Brochure, Dec., 1991.

*Primary Examiner*—Edward K. Look
*Assistant Examiner*—Christopher Verdier
*Attorney, Agent, or Firm*—Charles E. Baxley

[57] ABSTRACT

A housing for a ceiling fan includes a cylindrical member having a number of recesses formed on the outer peripheral surface for printing patterns. A cap is engaged on the cylindrical member and has a number of depressions formed in the upper surface for printing patterns. A number of panels are secured to the cap and to the cylindrical member, and may be formed with spatial patterns. The panels may be easily attached to the cylindrical member and the cap such that the patterns may be easily changed.

2 Claims, 3 Drawing Sheets

HOUSING FOR CEILING FAN

BACKGROUND OF THE INVENTION

1. Field of the Invention

The present invention relates to a housing, and more particularly to a housing for ceiling fans.

2. Description of the Prior Art

Typical ceiling fan housings comprising a lower cap, an upper cap and a cylindrical member clamped between the lower cap and the upper cap for housing the motor of the ceiling fan. The cylindrical member is normally made of glass materials and is normally formed, by molding processes, with three-dimensional or spatial patterns thereon for decorative purposes. However, the spatial patterns cannot be easily changed due to the expensive and definitive molds. In addition, the cylindrical members are made of glass material such that the color of the spatial patterns also cannot be easily changed.

The present invention has arisen to mitigate and/or obviate the afore-described disadvantages of the conventional ceiling fan housings.

SUMMARY OF THE INVENTION

The primary objective of the present invention is to provide a housing for a ceiling fan in which no spatial patterns are required to be formed on the cylindrical member and the decorative patterns can be easily changed.

In accordance with one aspect of the invention, there is provided a housing for a ceiling fan comprising a body including a cylindrical member and a bottom plate having an opening formed therein, the cylindrical member including an outer peripheral surface having at least one recess formed therein for providing patterns therein, at least one first panel secured onto the outer peripheral surface of the cylindrical member, a cap engaged on the body and including an upper surface having at least one depression formed therein for providing patterns therein, at least one second panel secured onto the upper surface of the cap for aligning with the first panel, and means for coupling the body and the cap together. The panels may be formed with spatial patterns and may be easily attached to the cylindrical member and the cap such that the patterns may be easily changed.

At least two plates are provided for engaging with the recess of the cylindrical member and for engaging with the depression of the cap respectively, and for providing patterns thereon. The plates may also be replaced for changing the decorating patterns.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
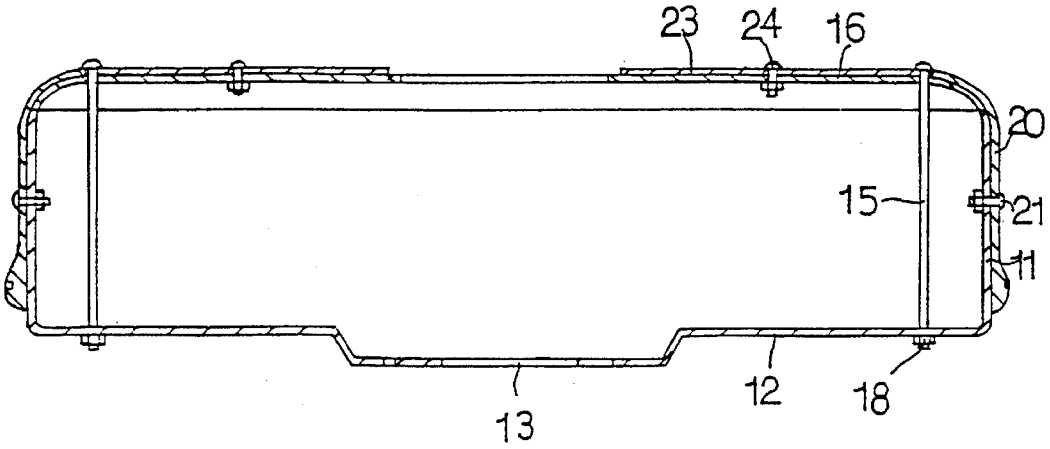
FIG. 2 is a cross sectional view taken along lines 2—2 of FIG. 1.
Figure 1:
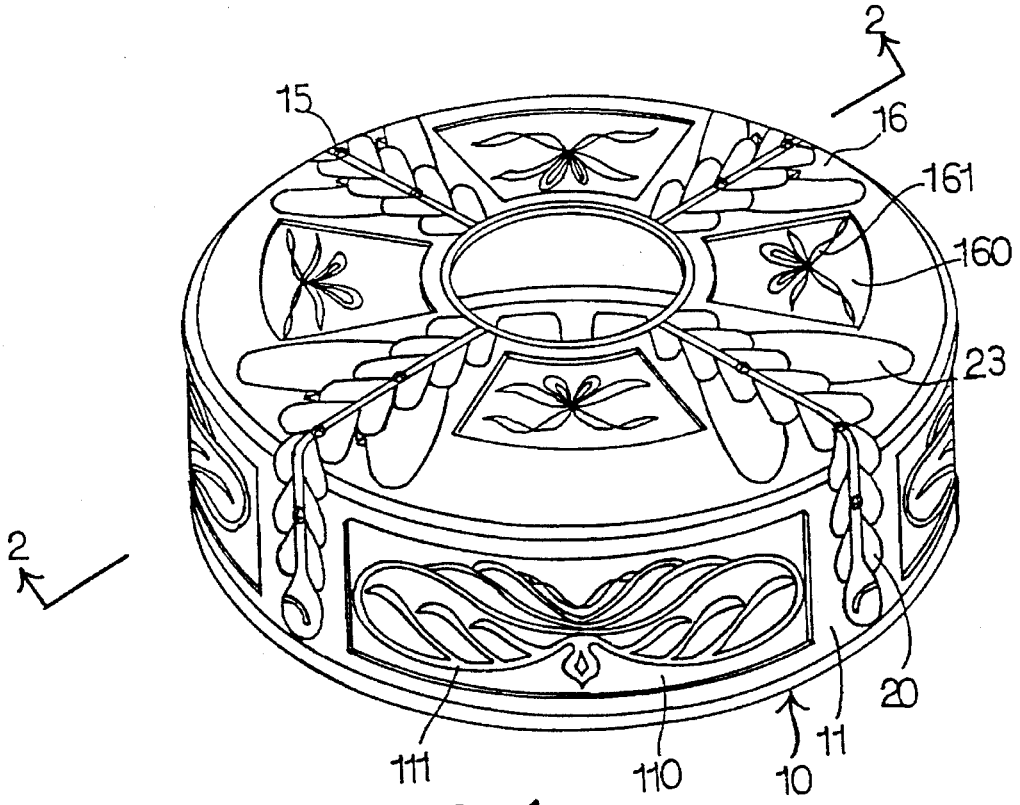
FIG. 1 is a perspective view of a housing for a ceiling fan in accordance with the present invention.
Figure 3:
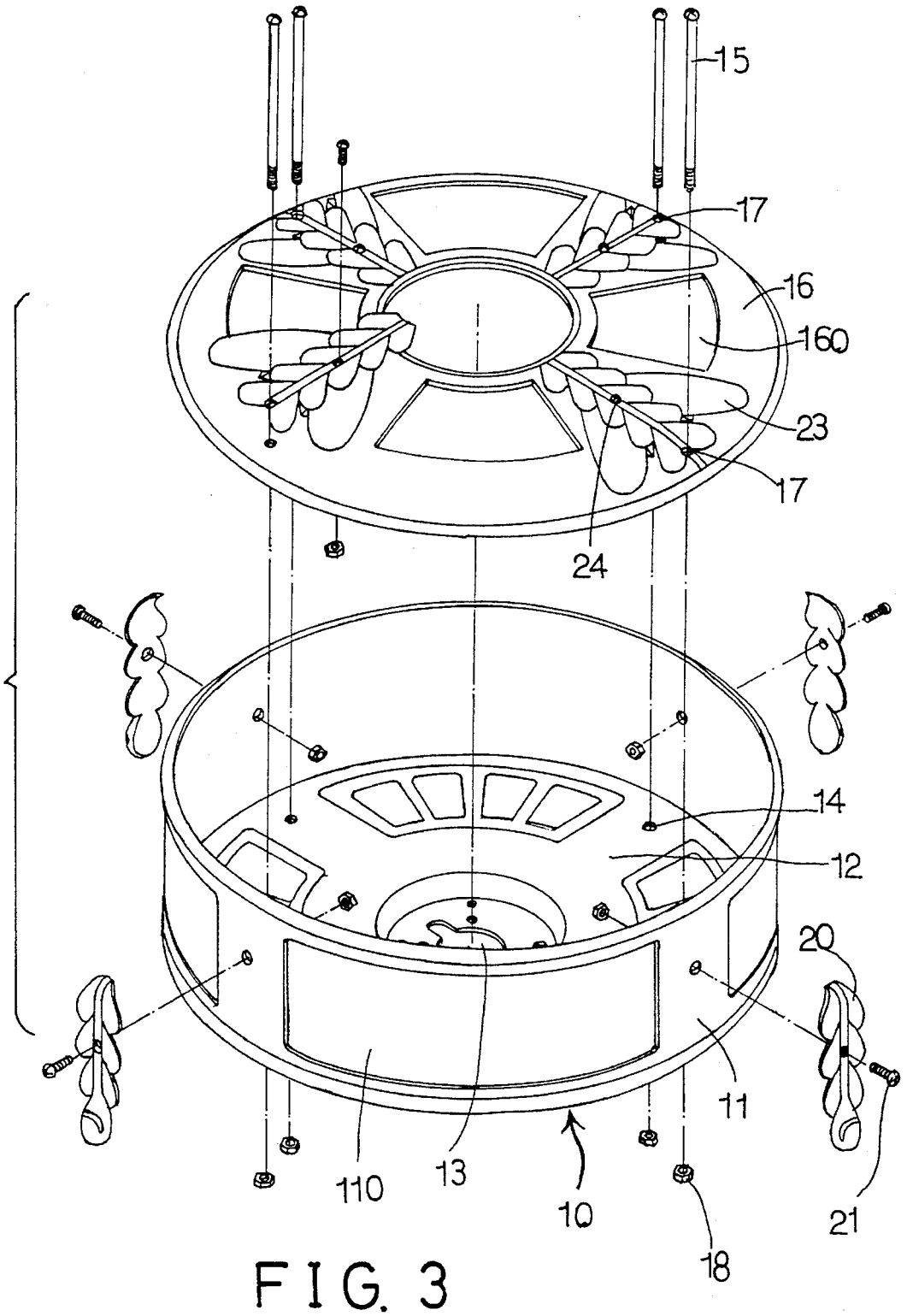
FIG. 3 is an exploded view of the ceiling fan housing.

Referring to the drawings, and initially to FIGS. 1 to 3, a housing in accordance with the present invention is provided for receiving the motor of the ceiling fans and comprises a body 10 which is preferably made of transparent materials including a cylindrical member 11 and a bottom plate 12. The cylindrical member 11 includes an outer peripheral surface having a number of recesses 110 formed therein. The bottom plate 12 includes an opening 13 formed in the center portion for insertion of a control box of the ceiling fan, and a number of holes 14 for engaging with bolts 15 which engage with holes 17 of a cap and threaded with nuts 18 so as to secure the cap and the body 10 in place. The cap 16 includes a number of depressions 160 formed therein. It is to be noted that the cylindrical member 11 and the bottom plate 12 can be easily manufactured by molding or forging processes.

A number of panels 20 are provided for securing to the outer peripheral surface of tile cylindrical member 11 by fastening screws 21. A number of panels 23 are provided for securing to the upper surface of the cap 16 by fastening screws 24. It is preferable that the panels 20 and 23 are aligned with each other, best shown in FIG. 1. It is further to be noted that the panels 20, 23 can be easily formed with spatial patterns thereon for decoration purposes. The panels 20, 23 can be formed with different patterns and colors and can be replaced for changing different patterns.

Figure 4:
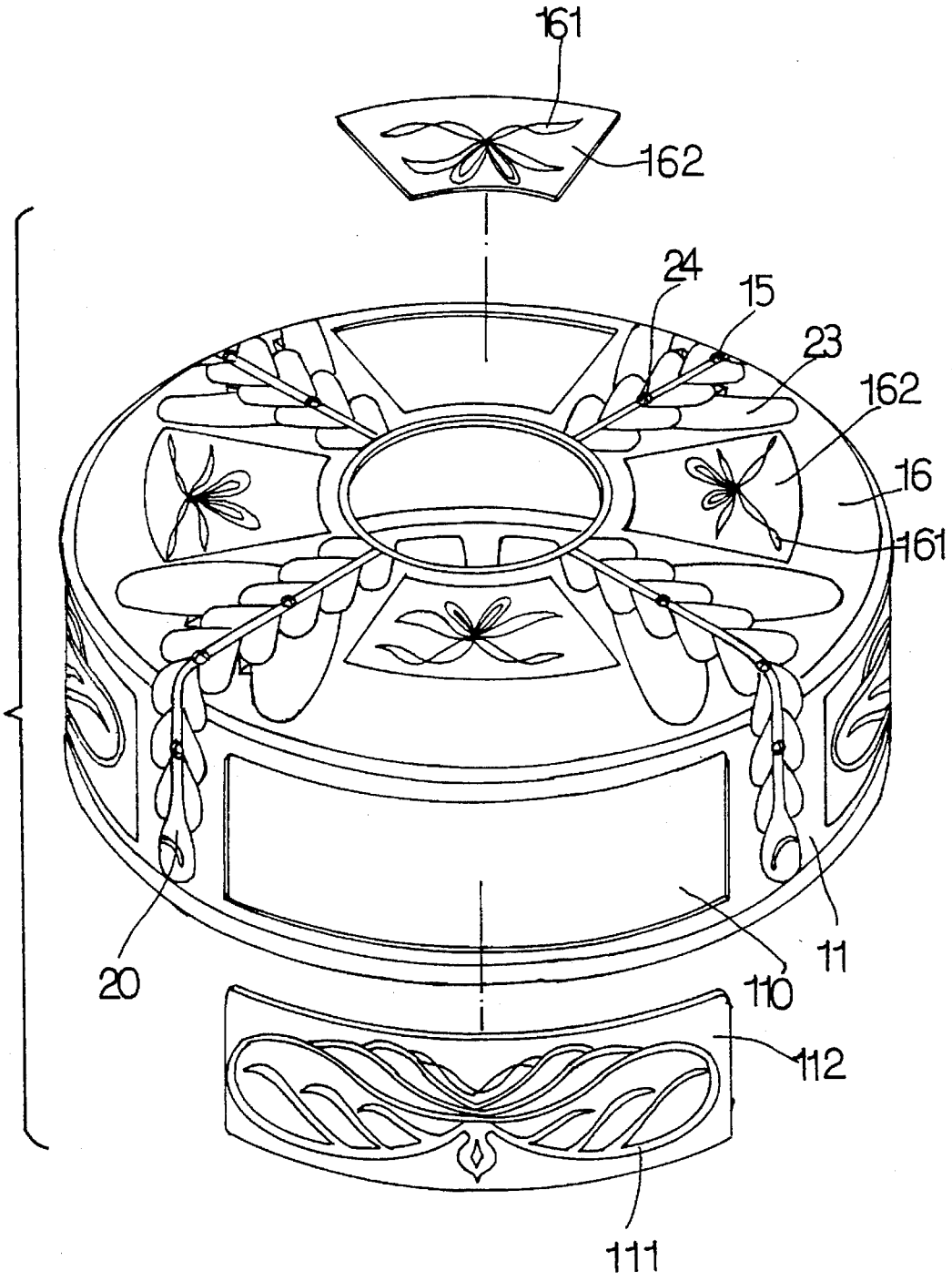
FIG. 4 is a partial exploded view illustrating another application of the ceiling fan housing.

Referring again to FIG. 1, a pattern 111, 161 ay be directly printed in the recesses 110 and depressions 160 of the outer peripheral surface of the cylindrical member 11 and of the cap 16. The patterns 111, 161 may also be printed on a transparent film which is then adhered onto the cylindrical member 11 and the cap 16. Alternatively, as shown in FIG. 4, the patterns 111, also be printed on a plate 112, 162 which may then be secured onto the cylindrical member 11 and the cap 16 by adhering means or fastening means.

Accordingly, the ceiling fan housing in accordance with the present invention includes a body that can be easily manufactured and includes a frame and panels that can be easily formed with different patterns and can be easily changed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A housing for a ceiling fan comprising:

a body including a cylindrical member and a bottom plate having an opening formed therein, said cylindrical member including an outer peripheral surface having at least one recess formed therein for providing patterns therein, at least one first panel secured onto said outer peripheral surface of said cylindrical member, a cap engaged on said body and including an upper surface having at least one depression formed therein for providing patterns therein, at least one second panel secured onto said upper surface of said cap for aligning with said first panel, and means for coupling said body and said cap together.

2. A housing according to claim 1 further comprising at least two plates for engaging with said recess of said cylindrical member and for engaging with said depression of said cap respectively, and for providing patterns thereon.

* * * * *